US006871570B1

(12) United States Patent
Santillan

(10) Patent No.: US 6,871,570 B1
(45) Date of Patent: Mar. 29, 2005

(54) RATCHET WRENCH WITH NUT-GRIPPING CLIP

(76) Inventor: Richard Santillan, 8111 S. Laramie, Burbank, IL (US) 60459

( * ) Notice: Subject to any disclaimer, the term of this patent is extended or adjusted under 35 U.S.C. 154(b) by 53 days.

(21) Appl. No.: 10/428,425

(22) Filed: May 3, 2003

(51) Int. Cl.[7] ..... B25B 13/02
(52) U.S. Cl. ..... 81/125; 81/60; 81/180.1
(58) Field of Search ..... 81/125, 60–63.2, 81/180.1, 185.2

(56) References Cited

U.S. PATENT DOCUMENTS 3,641,847 A * 2/1972 Horton ..... 81/111
3,892,150 A * 7/1975 Horton ..... 81/179
3,921,474 A * 11/1975 Dyck et al. ..... 81/91.2
6,718,849 B2 * 4/2004 Haas ..... 81/55

* cited by examiner

*Primary Examiner*—Joseph J. Hall, III
*Assistant Examiner*—Alvin J Grant

(57) ABSTRACT

An improved ratchet or gear wrench that has a built-in, non-slip, gripping clip mechanism for retaining a nut in the tool, which can either be applied to the nut or clamped out-of-the-way. This tool allows a nut to be tightened or loosened from a bolt or threaded stud more quickly and with one hand. To attain this, the present invention essentially comprises a spring-loaded curveshaped gripping clip, mounted near the boxed-end of a ratchet wrench, which wraps around the opening of the wrench. The spring action of the gripping clip allows it to be easily pulled away from the opening of the wrench and clamped in an out-of-the-way position by means of a clamp or released into a functional gripping position by pushing downward on the clamp's release button. When released, the gripping clip presses against a nut, thereby creating pressure that secures the nut in the opening of the wrench. Optionally, a second gripping clip mechanism can be added on the opposite side of the wrench, positioned to apply force on the nut from the opposite direction, thereby providing non-slip nut retaining capability. In use, a mechanic or user will pull the spring-loaded gripping clip back away from the wrench's opening and snap it into the clamp, thereby storing potential energy in the spring. A nut is then placed in the wrench opening and the clamp's release button is pressed momentarily in a downward motion, releasing the gripping clip and allowing the spring to pull the gripping clip against the nut. The nut can be started on the bolt using only one hand and then quickly tightened without the wrench slipping off the nut. When removing a nut, the nut will remain retained in the tool until the user removes it, thereby preventing the nut from falling into an undesirable location that may make it difficult to find or reach.

19 Claims, 4 Drawing Sheets

RATCHET WRENCH WITH NUT-GRIPPING CLIP

BACKGROUND OF THE INVENTION

1. Field of the Invention

The present invention relates to tools for use in connection with installing and removing threaded nuts from a threaded bolt or stud. The ratchet wrench with nut gripping clip has particular utility in connection with capturing and holding the nut while it is being installed or removed, thereby allowing one-hand operation of the wrench.

2. Description of the Prior Art

Ratchet wrenches are commonly used to install or remove a nut, particularly in locations where there is not much working room. However, a problem often encountered with these wrenches is that they tend to slip off the nut, requiring that the wrench be held on the nut with one hand while being operated with the other hand. It would be desirable to have an improved mechanism built into the wrench that captures and holds the nut while it is being removed or tightened.

The use of nut-retaining mechanism on tools is known in the prior art. For example, U.S. Pat. No. 2,369,406 to Malcom discloses a nut holder for open-end wrenches that uses a spring wire gripping means to hold a nut in an open end wrench for assistance in starting the threading of a nut on a bolt or threaded stud. However, the Malcom '406 patent does not disclose a capturing mechanism for use with closed-end wrenches and is different in structure from the non-slip clip mechanism disclosed in the present invention.

U.S. Pat. Nos. 5,323,672 and D359,212 to Skiba disclose a mechanism and wrench design having a locking assembly for maintaining a box wrench engaged with a bolt head that uses a small BB-type ball that is pushed outward against the bolt head by means of a resilient pad. However, the gripping mechanism of the Skiba '372 and '212 patents does not provide the non-slip capability that grips the nut from different directions on both sides of the wrench and is different in structure from that of the non-slip clip mechanism disclosed in the present invention.

Similarly, U.S. Pat. No. 4,570,513 to Thompson discloses a wrench with nut-retaining mechanism, which has a detent that can be projected into or released from the wrench cavity by means of a thumb-operated keeper (lever) and latch for the purpose of holding a nut. However the gripping mechanism of the Thompson '513 patent is different in structure from that of the non-slip clip mechanism disclosed in the present invention, which incorporates a separate locking clip on each side of the wrench.

Also, U.S. Pat. No. 1,655,168 to Speckman discloses a closed-end ratchet type wrench with a thin attached open-end wrench that can be positioned around a nut for retaining the nut while installing or removing it. However, the gripping mechanism of the Thompson '513 patent is different in structure from that of the non-slip clip mechanism disclosed in the present invention, which incorporates a separate locking clip on each side of the wrench.

Lastly, U.S. Pat. No. 1,390,408 to Webber discloses an open-end wrench with built-in mechanism for assisting in holding the wrench on a nut while turning the nut. The mechanism uses a spring loaded lever that rotates around a pivot point to apply pressure against the nut, thereby capturing it in place. However, as with the above mentioned patents, the gripping mechanism of the Webber '408 patent is different in structure from that of the non-slip clip mechanism disclosed in the present invention, which incorporates a separate locking clip on each side of the wrench.

While the above-described tools fulfill their respective, particular objectives and requirements, the aforementioned patents do not describe a ratchet wrench with non-slip gripping mechanism that allows a nut to be captured from one or both sides of the wrench.

Therefore, a need exists for a new and improved ratchet wrench with non-slip gripping feature that can be used for capturing and retaining a nut while turning the nut on a bolt or threaded stud. In this regard, the present invention substantially fulfills this need. In this respect, the ratchet wrench with non-slip gripping clip according to the present invention substantially departs from the conventional concepts and designs of the prior art, and in doing so provides an apparatus primarily developed for the purpose of capturing and retaining a nut while turning the nut on a bolt or threaded stud.

SUMMARY OF THE INVENTION

In view of the foregoing disadvantages inherent in the known types of nut-retaining mechanism for use on wrenches now present in the prior art, the present invention provides an improved ratchet wrench with non-slip gripping clip, and overcomes the above-mentioned disadvantages and drawbacks of the prior art. As such, the general purpose of the present invention, which will be described subsequently in greater detail, is to provide a new and improved ratchet wrench with non-slip gripping clip and method which has all the advantages of the prior art mentioned heretofore and many novel features that result in a tool that is not anticipated, rendered obvious, suggested, or even implied by the prior art, either alone or in any combination thereof.

The tool disclosed in the present invention is an improved ratchet or gear wrench that has a built-in, non-slip, gripping clip mechanism for retaining a nut in the tool, which can either be applied to the nut or clamped out-of-the-way. This tool allows a nut to be tightened or loosened from a bolt or threaded stud more quickly and with one hand. The wrench can be produced in standard sizes, thereby making it usable for most any job.

To attain this, the present invention essentially comprises a spring-loaded curve-shaped gripping clip, mounted near the boxed-end of a ratchet wrench, which wraps around the ratchet opening of the wrench. The spring action of the gripping clip allows it to be easily pulled away from the ratchet opening of the wrench and clamped in an out-of-the-way position by means of a clamp or released into a functional gripping position by pushing downward on the clamp's release button. When released, the gripping clip presses against a nut (or bolt head), thereby creating pressure that secures the nut in the ratchet opening of the wrench. Optionally, a second gripping clip mechanism can be added on the opposite side of the wrench, positioned to apply force on the nut from the opposite direction, thereby providing non-slip nut retaining capability.

In use, a mechanic or user will pull the spring-loaded gripping clip back away from the wrench's ratchet opening and snap it into the clamp, thereby storing potential energy in the spring. A nut is then placed in the wrench opening and the clamp's release button is pressed momentarily in a downward motion, releasing the gripping clip and allowing the spring to pull the gripping clip against the nut. The nut can be started on the bolt using only one hand and then quickly tightened without the wrench slipping off the nut. When removing a nut, the nut will remain retained in the tool until the user removes it, thereby preventing the nut from falling into an undesirable location that may make it difficult to find or reach.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ratchet wrench with non-slip gripping clip that provides in the apparatuses and methods of the prior art some of the advantages thereof, while simultaneously overcoming some of the disadvantages normally associated therewith.

It is another object of the present invention to provide a new and improved ratchet wrench with non-slip gripping clip that may be easily and efficiently manufactured and marketed.

An even further object of the present invention is to provide a new and improved ratchet wrench with non-slip gripping clip that has a low cost of manufacture with regard to both materials and labor, and which accordingly is then susceptible of low prices of sale to the consuming public, thereby making such tools economically available to the buying public.

Lastly, it is an object of the present invention to provide a new and improved method for capturing and retaining a nut while installing or removing it from a bolt or threaded stud using only one hand.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
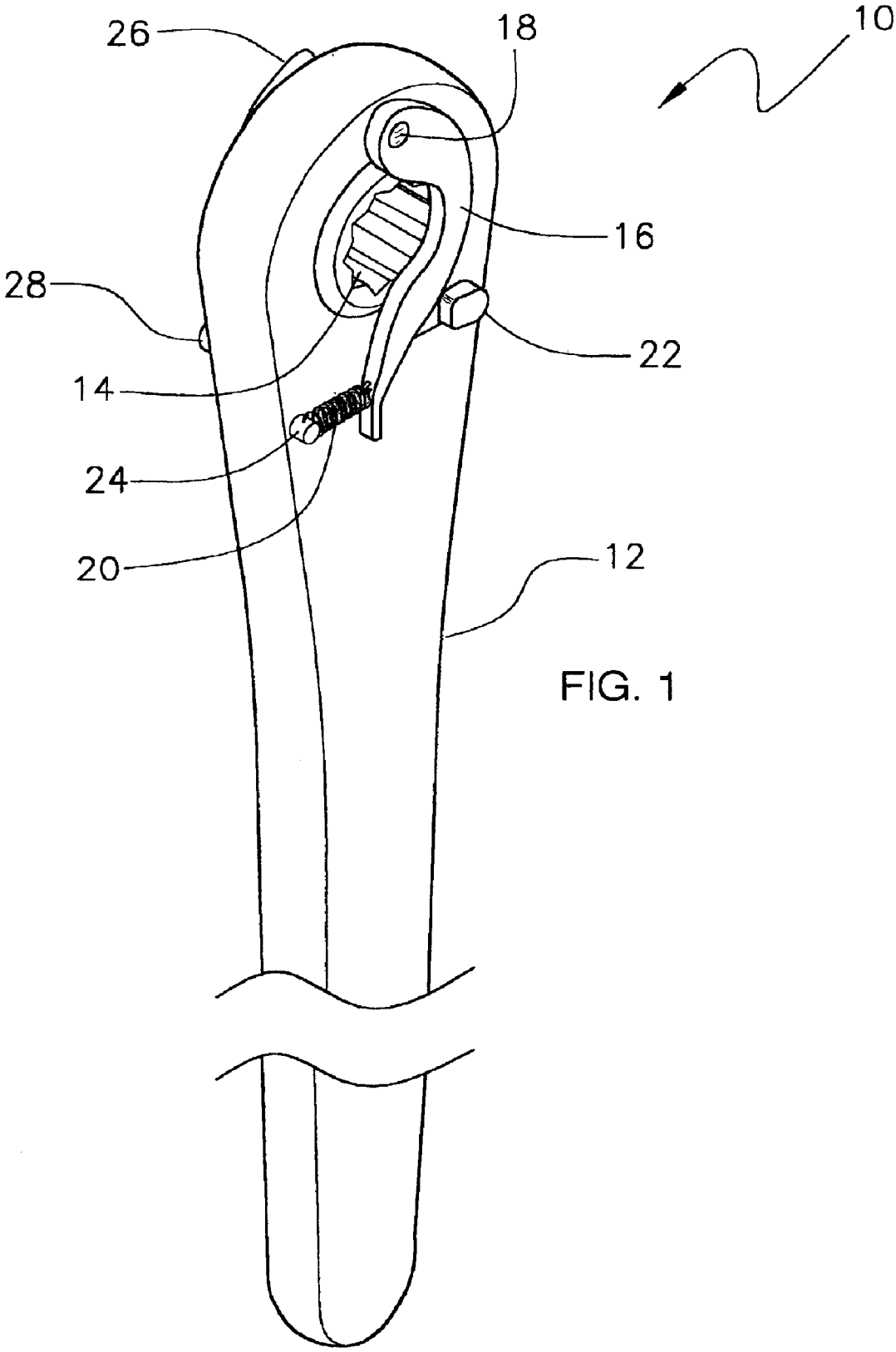
FIG. 1 is a perspective view of the preferred embodiment of a ratchet wrench with nonslip gripping clip constructed in accordance with the principles of the present invention.

Referring now to the drawings, and particularly to FIGS. 1–6, a preferred and second embodiment of the wrench with non-slip gripping clip of the present invention is shown and generally designated by the reference numerals 10 and 50, respectively.

In FIG. 1, a new and improved ratchet wrench with non-slip gripping clip of the preferred embodiment of the present invention, for retaining a nut while installing or removing it from a bolt or threaded stud, is illustrated and will be described. More particularly, the ratchet wrench 10 with non-slip gripping clip has a ratchet gear opening 14 on one end and a wrench handle 12 for holding the wrench. The wrench also has a spring-loaded, curve-shaped, gripping clip 16, pivotally 18 attached near the boxed-end of the ratchet opening, which wraps around the ratchet opening 14 of the wrench. A tension spring 20 is connected between a spring securing post 24 and the end of the gripping clip opposite the pivot attached end. The spring action of the gripping clip 16 allows it to be easily pulled away from the ratchet opening 14 of the wrench and secured in an out-of-the-way position by means of a clamp with release button 22 or released into a functional gripping position by pushing downward on the release button. When released, the gripping clip presses against the nut, thereby creating pressure that secures the nut in the ratchet opening of the wrench. Optionally, a second gripping clip 26, tension spring and post, and clamp with release button 28 can be added on the opposite side of the wrench, positioned to apply force on the nut from the opposite direction, thereby providing non-slip retaining capability to the nut.

Figure 2:
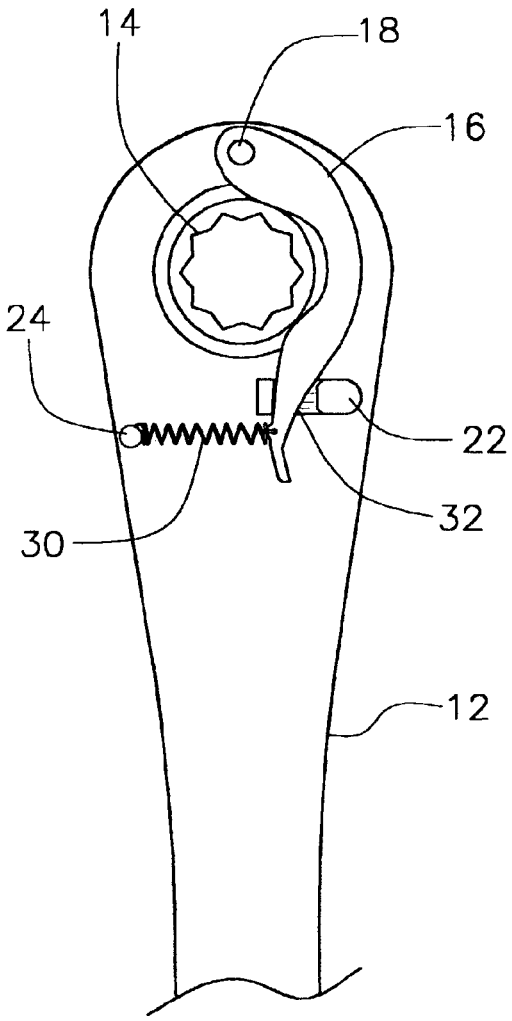
FIG. 2 is a front view of the ratchet wrench with non-slip gripping clip of the present invention showing the gripping clip clamped away from the nut.

FIG. 2 is a front view of the ratchet wrench 10 with non-slip gripping clip of the present invention showing the gripping clip being clamped 32 away from the nut. In this case, the gripping clip 16 is pulled back, stretching the tension spring 20 (shown in stretched position 30), and snapped into the clamp 22. This position of the gripping clamp allows for a nut to be placed in the ratchet opening 14 and stores potential energy in the stretched tension spring 30.

Figure 3:
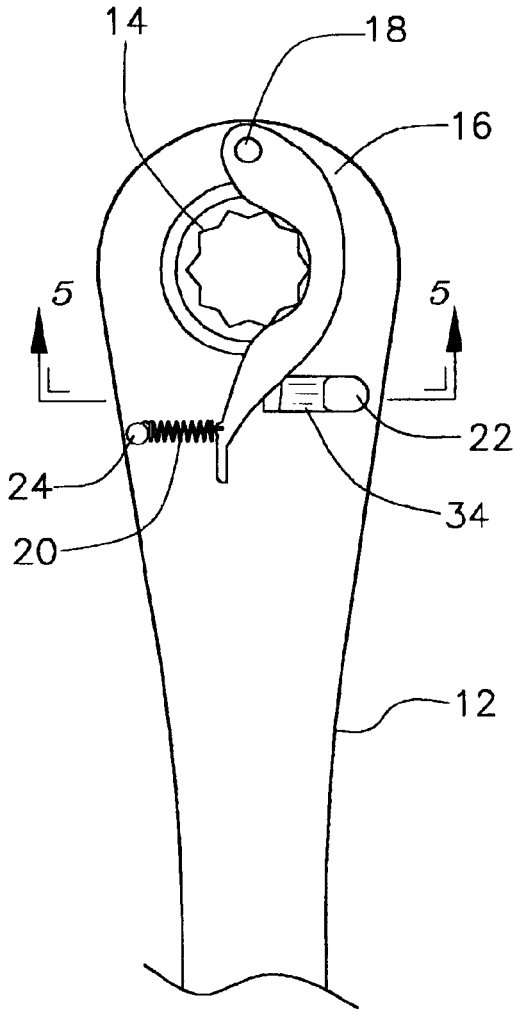
FIG. 3 is a front view of the ratchet wrench with non-slip gripping clip of the present invention showing the gripping clip in place for capturing a nut.

FIG. 3 is a front view of the ratchet wrench 10 with non-slip gripping clip of the present invention showing the gripping clip released in a nut clamping position. In this case, the clamp 22 is pressed downward, releasing 34 the gripping clip 16 to be pulled into the ratchet opening area, thereby clamping a nut in the ratchet opening by releasing the potential energy stored in the tension spring 20.

Figure 4:
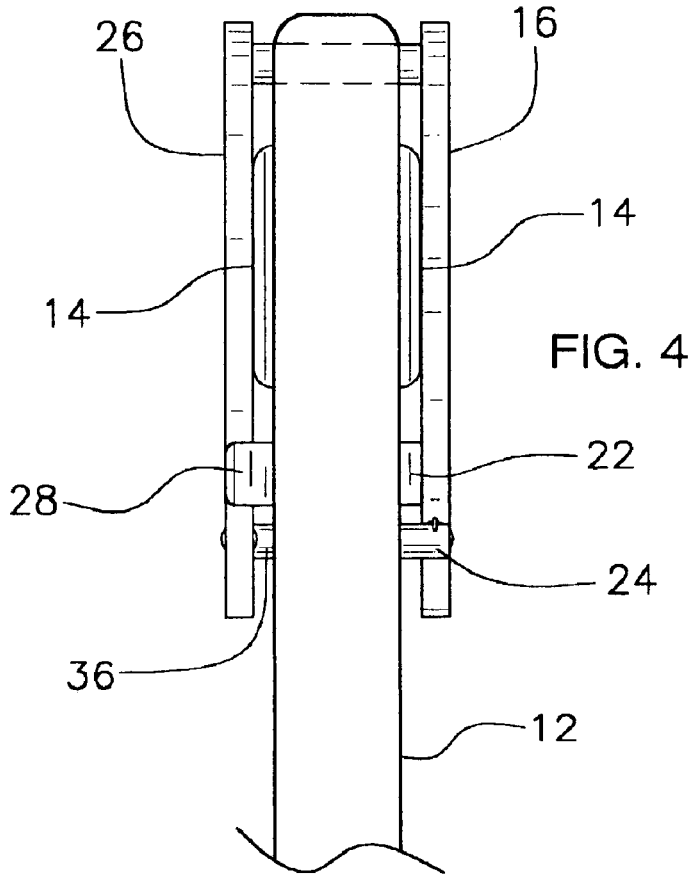
FIG. 4 is a side view of the ratchet wrench with non-slip gripping clip of the present invention showing gripping clips on both sides of the wrench.

FIG. 4 is a side view of the ratchet wrench 10 with non-slip gripping clip of the present invention showing more clearly the gripping clips 16,26 on both sides of the wrench. The gripping clip 16, tension spring post 24, and clamp with release button 22 are shown on a first side (front) of the wrench 10. On the second side (back) of the wrench are shown a second gripping clip 26, tension spring post 36, and clamp with release button 28. Notice that the two gripping clamps rotate from different sides of the nut, thereby clamping it from both sides to provide non-slip retention of the nut.

Figure 5:
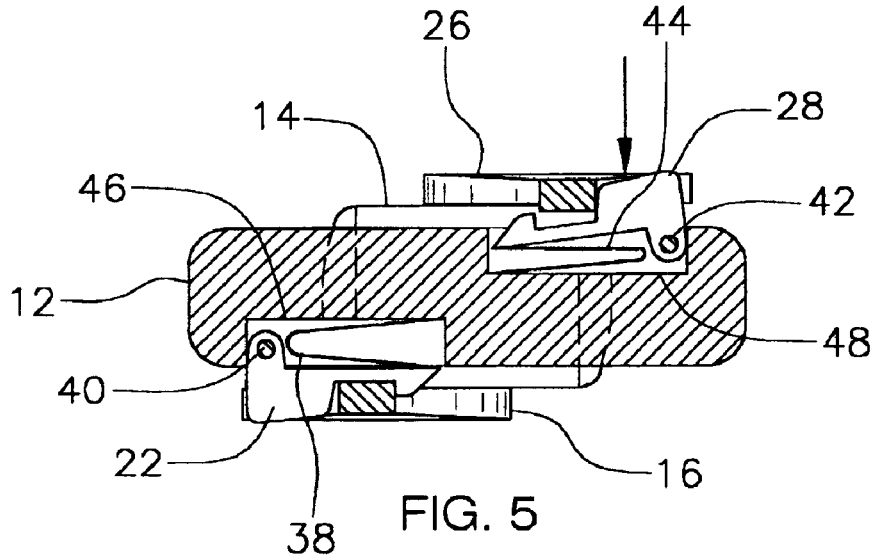
FIG. 5 is a cross-sectional view of a portion of the ratchet wrench with non-slip gripping clip of the present invention showing details of the gripping clip mechanism.

FIG. 5 is a cross-sectional view of a portion of the ratchet wrench 10 with non-slip gripping clip of the present invention showing details of the gripping clip mechanism. Again, this shows the gripping clip mechanism mounted on both sides of the wrench to provide clamping to both sides of the nut. On one side (front) the gripping clip 16 is shown clamped out-of-the-way by clamp 22, which is pivoted 40 into an outward position by means of a first release clamp spring 38 installed in a first wrench body cavity 46. Similarly, on the second side (back) the gripping clip 26 is shown released from the clamp 28, which is pivoted 42 into a downward position, compressing a second release clamp spring 44 installed in a second wrench body cavity 48. The clamp 28 and clamp spring 44 are held down by the gripping clip 26 being positioned over the outside comer of the clamp 28.

Figure 6:
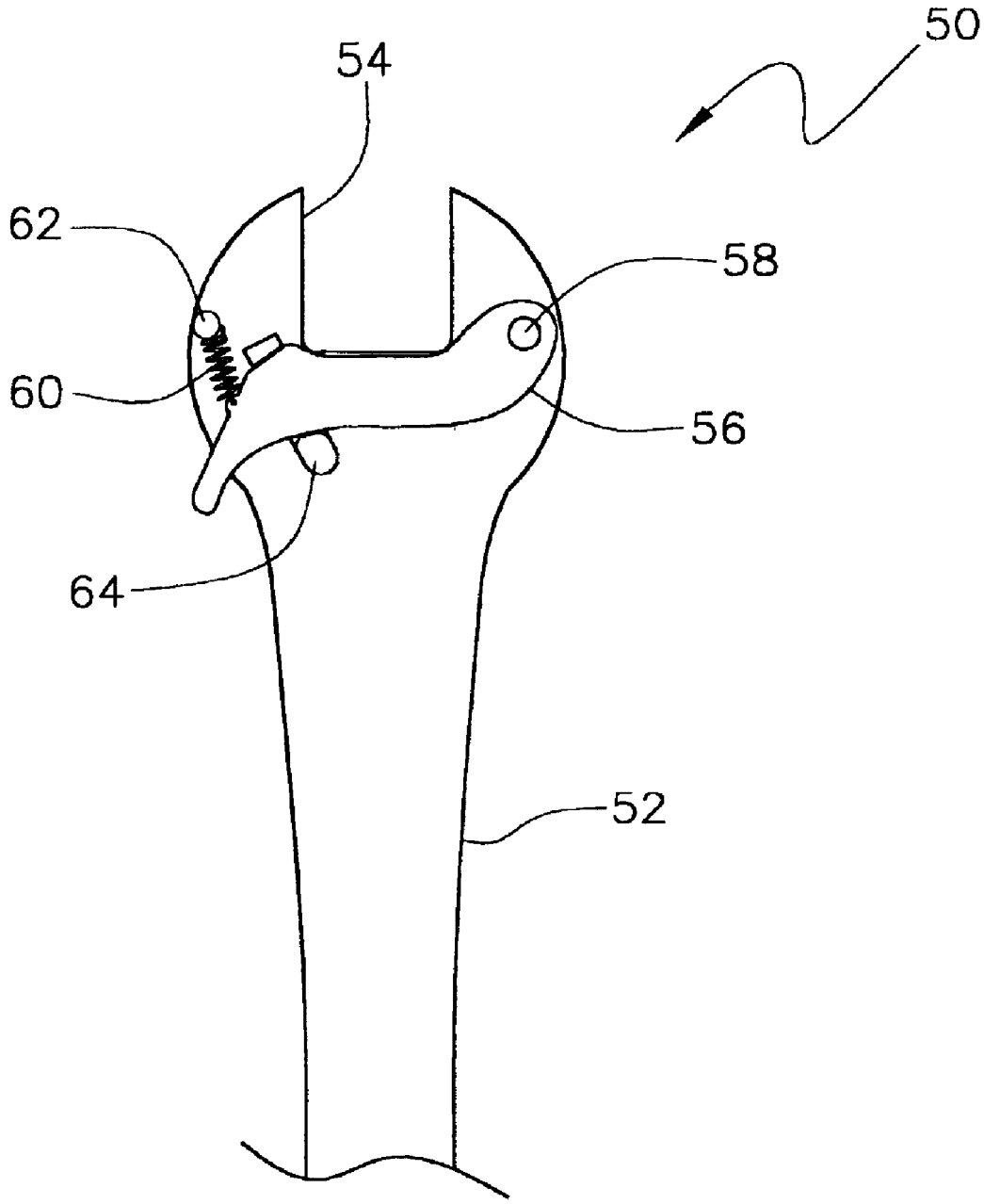
FIG. 6 is a perspective view of a second embodiment of the present invention for an open-end wrench with non-slip gripping clip, primarily for use in starting a nut on a bolt or threaded stud.

Finally, FIG. 6 is a perspective view of a second embodiment of an open-end wrench 50 with the non-slip gripping clip constructed in accordance with the principles of the present invention, primarily for use in starting a nut on a bolt or threaded stud. In this case, the wrench has a handle 52 and a spring-loaded, S-shaped, gripping clip 56, pivotally 58 attached near the open-end 54 of the wrench, which wraps around the ratchet opening 54 of the wrench. A tension spring 60 is connected between a spring securing post 62 and the end of the gripping clip opposite the pivot attached end. The spring action of the gripping clip 56 allows it to be easily pulled away from the ratchet opening 54 of the wrench and secured in an out-of-the-way position by means of a clamp with release button 64 or released into a functional gripping position by pushing downward on the button clamp.

In use, the mechanic or user will pull the spring-loaded gripping clip back away from the ratchet opening and snap it into the clamp, thereby storing potential energy in the spring. A nut is then placed in the ratchet opening and the clamp's release button is pressed momentarily in a downward motion, releasing the gripping clip and allowing the spring to pull the gripping clip against the nut. The nut can be started on the bolt using only one hand and then quickly tightened without the wrench slipping off the nut. When removing a nut, the nut will remain retained in the tool until the user removes it, thereby preventing the nut from falling into an undesirable location that may make it difficult to find or reach.

While a preferred embodiment of the ratchet wrench with non-slip gripping clip has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the non-slip gripping mechanism can be used on either one side or both sides of the wrench. Also, the gripping mechanism can be used with various wrench types.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A wrench with non-slip mechanism for capturing and retaining a nut, comprising:

a wrench body, said body having a sized opening area for receiving a nut on at least one end of said wrench, said body further having a hand grip area for holding said wrench; and a releasable, spring-loaded, pivotally-attached gripping clip means mounted around one side of said sized opening for retaining said nut, wherein said gripping clip means further comprises a spring-loaded pivotal-clamp with release button positioned on said wrench so as to hold said gripping clip away from said nut and release said gripping clip against said nut when said release button is pushed downward into a wrench cavity.

2. The apparatus of claim 1, wherein one end of said gripping clip means is pivotally attached near the receiving end of said wrench so as to be capable of swinging into and out of said sized opening area.

3. The apparatus of claim 1, wherein said gripping clip means further comprises a tension spring attached to the end of said gripping clip opposite the pivotally attached end for pulling said gripping clip against said nut.

4. The apparatus of claim 1, wherein said gripping clip means further comprises a tension spring post attached to said wrench body at a point to force said gripping clip against said nut.

5. The apparatus of claim 1, wherein said wrench is a closed-end ratchet wrench.

6. The apparatus of claim 1, wherein said wrench is an open-end wrench with said gripping clip means being used in starting a nut on a bolt.

7. The apparatus of claim 1, wherein said spring-loaded gripping clips are mounted on both sides of said wrench, thereby providing force from opposite directions against said nut.

8. The apparatus of claim 1, wherein parts for said gripping means are made of material from the group comprised of: stainless steel, forged steel, tool-grade steel, and plated brass.

9. A ratchet wrench with non-slip gripping mechanism for capturing and retaining a nut, comprising:

a ratchet wrench body, said body having an opening for receiving a nut on at least at one end of said wrench, said body further having a hand grip area for holding said wrench;

a gripping clip means pivotally attached at one end to an area of said ratchet wrench near said opening and so arranged to swing into and out of the area of said opening;

a tension spring attached to the end of said gripping clip opposite the pivotally attached end for pulling said gripping clip against said nut;

a tension spring post attached to said ratchet wrench body at a point to force said gripping clip against said nut; and a spring-loaded pivotal clamp with release button positioned on said wrench so as to hold said gripping clip away from said nut and release said gripping clip against said nut when said release button is pushed downward into a ratchet wrench cavity.

10. The apparatus of claim 9, wherein said spring-loaded gripping clips are mounted on both sides of said ratchet wrench, thereby providing force from opposite directions against said nut.

11. The apparatus of claim 9, wherein parts for said gripping means are made of material from the group comprised of: stainless steel, forged steel, tool-grade steel, and plated brass.

12. The apparatus of claim 9, wherein when removing a nut said nut is retained in said ratchet wrench until released by user.

13. The apparatus of claim 9, wherein said non-slip gripping mechanism is used on an open-end wrench located on at least one end of said wrench for starting a nut on to a bolt.

14. A one hand method for applying a nut to bolt or threaded stud in a tight location, comprising the steps of:

providing a wrench with built-in mechanism for capturing and retaining a nut, said mechanism further comprising:

a wrench body, said body having an opening for receiving a nut on at least at one end of said wrench, said body further having a hand grip area for holding said wrench;

a gripping clip means pivotally attached at one end to an area of said wrench near said opening and so arranged to swing into and out of the area of said opening;

a tension spring attached to the end of said gripping clip opposite the pivotally attached end for pulling said gripping clip against said nut;

a tension spring post attached to said wrench body at a point to force said gripping clip against said nut; and a spring-loaded pivotal clamp with release button positioned on said wrench so as to hold said gripping clip away from said nut and release said gripping clip against said nut when said release button is pushed downward into a ratchet wrench cavity;

pulling the spring end of said gripping clip back so as to snap into said clamp with release button, thereby holding said gripping clip out of the way of said opening for receiving a nut:

placing said wrench over said nut;

pushing downward on said clamp's release button to release said gripping clip against said nut;

tightening or loosening said nut; and again pulling the spring end of said gripping clip back so as to snap into said button clamp, thereby releasing said wrench from said nut.

15. The method of claim 14, wherein said wrench is a closed-end ratchet wrench.

16. The method of claim 14, wherein said wrench is an open-end wrench with said gripping clip means being used in starting a nut on a bolt.

17. The method of claim 14, wherein said spring-loaded gripping clips are mounted on both sides of said wrench, thereby providing force from opposite directions against said nut.

18. The method of claim 14, wherein when removing a nut said nut is retained in said wrench until released by user.

19. The method of claim 14, wherein parts for said gripping means are made of material from the group comprised of: stainless steel, forged steel, tool-grade steel, and plated brass.

* * * * *